US006022302A

United States Patent [19]

McBride

[11] Patent Number: 6,022,302

[45] Date of Patent: Feb. 8, 2000

[54] FLEXURAL EXERCISE DEVICE

[75] Inventor: Robert W. McBride, Springfield, Mo.

[73] Assignee: Stamina Products, Inc., Springfield, Mo.

[21] Appl. No.: 09/074,647

[22] Filed: May 8, 1998

[51] Int. Cl.[7] ..... A63B 21/02

[52] U.S. Cl. ..... 482/121; 482/122; 482/126

[58] Field of Search ..... 482/128, 121–127

[56] References Cited

U.S. PATENT DOCUMENTS

| | | | |
|---|---|---|---|
| 4,489,937 | 12/1984 | Kong . | |
| 4,623,146 | 11/1986 | Jackson | 482/126 |
| 4,718,666 | 1/1988 | O'Donnell et al. . | |
| 4,789,154 | 12/1988 | Mattox . | |
| 4,852,873 | 8/1989 | O'Donnell et al. . | |
| 4,856,776 | 8/1989 | Ching-Liang . | |
| 4,865,316 | 9/1989 | Yeaman . | |
| 5,022,648 | 6/1991 | Travis | 482/126 |
| 5,246,413 | 9/1993 | Koblick . | |
| 5,507,712 | 4/1996 | Chang | 482/126 |
| 5,514,055 | 5/1996 | Elliott . | |
| 5,569,137 | 10/1996 | Uen . | |
| 5,643,158 | 7/1997 | Clementi . | |
| 5,713,822 | 2/1998 | Newman et al. | 482/126 |
| 5,904,640 | 5/1999 | Shahinian . | |

*Primary Examiner*—Jerome Donnelly
*Attorney, Agent, or Firm*—Pillsbury Madison & Sutro LLP, Intellectual Property Group

[57] ABSTRACT

A flexural exercise device includes two oppositely-extending arm structures connected to one another by a resilient element, preferably in the form of a coil spring, disposed therebetween to which the inner ends of the arm structures are attached. The middle resilient member is covered by a padded neck roll. Each arm structure preferably comprises a tubular element extending away from the central resilient member and having an initial straight portion and a laterally bent handle portion at the end of the straight portion. The laterally bent handle portion provides a hand-gripping structure, and the transversely bent portions of each of the arm structures are bent so that the hand-gripping portions thereof are directed in directions generally toward one another so that a free end of each hand-gripping portion is disposed inwardly of an outermost extremity of the respective arm structure. The arm structures are preferably bent, steel tube construction and are preferably covered with a foam padding layer.

12 Claims, 2 Drawing Sheets

FLEXURAL EXERCISE DEVICE

This application claims the benefit of prior filed provisional application number 60/068,561, filed Dec. 23, 1997.

FIELD AND BACKGROUND OF THE INVENTION

The present invention relates to a flexural exercise device which permits a user of the device to properly perform a butterfly press-type exercise therewith.

A variety of flexural exercise devices have been proposed which comprise an elongated apparatus with handle portions disposed on opposite ends thereof and a flexural middle portion therebetween. The handle portions of the apparatus can be grasped by each of the hands of a user, and the handle portions can be flexed with respect to the flexural middle portion against a flexural resistance generated by the flexural middle portion of the apparatus. A variety of exercises can be performed by such prior art flexural exercise devices by flexing one or both handle portions with respect to the flexural middle portion while holding the device in a variety of orientations.

A popular upper body exercise, which isolates certain muscles of the chest and particularly the pectoral muscles, is typically referred to as the upright butterfly press. In its proper form, the upright butterfly press is performed using a specialized butterfly press machine by an exerciser standing or sitting with a generally upright posture. The exerciser extends his arms out to his sides, bent upwardly at the elbows with the exerciser's hands extending generally above the exerciser's shoulders so that the forearms are oriented generally vertically and the upper arms are in a generally horizontal orientation. The hands and forearms are pressed against arm-engaging portions of two mechanisms of the butterfly machine that move in arcuate paths against a resistance as the exerciser's arms are brought together in front of the exerciser and then brought back to the sides of the exerciser, while maintaining the forearms in the generally vertical orientation and the upper arms in the generally horizontal orientation, to effect one repetition of the exercise.

Many prior art flexural exercise apparatuses permit a user to place the apparatus behind the user's neck with the handle portions of the unflexed apparatus extending to both sides of the user's head at about shoulder level. The user can grasp the handles with the user's arms extending sideways and flex the handles forwardly to a position in front of the user to approximate a butterfly press exercise.

Prior art flexural exercise devices do not, however, provide handle structures which permit a user to properly perform a butterfly exercise. That is, the handle structures of the prior art flexural exercise devices do not provide structures which can be grasped by a user's arms extending out to the user's sides and bent upwardly at the elbows with the user's hands extending above the user's shoulders so that the user's upper arms are in a generally horizontal orientation. Accordingly, prior art flexural exercise devices do not permit a user to perform a proper upright butterfly press, and thus, an exerciser needs a specialized butterfly press machine in order to perform a proper butterfly press exercise.

SUMMARY OF THE INVENTION

The present invention overcomes the limitations of prior art flexural exercise devices by providing a flexural exercise device which permits a user to perform a proper butterfly press exercise with the device. The flexural exercise device comprises a first arm structure, a second arm structure, and a flexural connecting assembly having structure for connecting the first arm structure with the second arm structure with the first and second arm structures extending in generally opposite directions from the flexural connecting assembly when the first and second arm structures are in unflexed positions.

The flexural connecting assembly is constructed and arranged to permit each of the first and second arm structures to flex with respect to their respective positions against a flexural resistance provided by the flexural connecting assembly.

The first arm structure includes an initial portion extending away from the flexural connecting assembly and a transverse handle structure attached to the initial portion at a position spaced from the flexural connecting assembly. Similarly, the second arm structure includes an initial portion extending away from the flexural connecting assembly in a direction generally opposite to the direction of the initial portion of the first arm structure when the first and second arm structures are in their respective unflexed positions and a transverse handle structure attached to the initial portion at a position spaced from the flexural connecting assembly.

The transverse handle structures of the respective first and second arm structures includes portions extending away from the initial portions of the respective first and second arm structures in directions generally toward one another when the first and second arm structures are in their respective unflexed positions so that a free end of each transverse handle structure is disposed inwardly of an outermost extremity of the respective first and second arm structure.

The first and second arm structures are constructed and arranged with respect to the flexural connecting assembly to permit a standing user to (1) position the device with the flexural connecting assembly behind the user's neck, the first and second arm structures directed sideways from the user, and the transverse handle structures of the first and second arm structures extending above the user's shoulders when the first and second arm structures are in their respective unflexed positions, (2) extend the user's arms outwardly and bent upwardly at the elbows and manually grasp the transverse handle structures of the respective first and second arm structures at positions above the user's shoulders and spaced inwardly from the outermost extremities of the respective first and second arm structures, and (3) effect a butterfly exercise by bending the user's arms at the shoulders toward one another in front of the user while keeping the arms bent upwardly at the elbows and while flexing the first and second arm structures from their respective unflexed positions against the flexural resistance.

These and other features of the present invention, as well as methods of use and construction, will become more apparent during the course of the following detailed description and appended claims. The invention may best be understood with the reference to the accompanying drawings wherein an illustrative embodiment is shown.

DETAILED DESCRIPTION OF THE DRAWING

Figure 1:
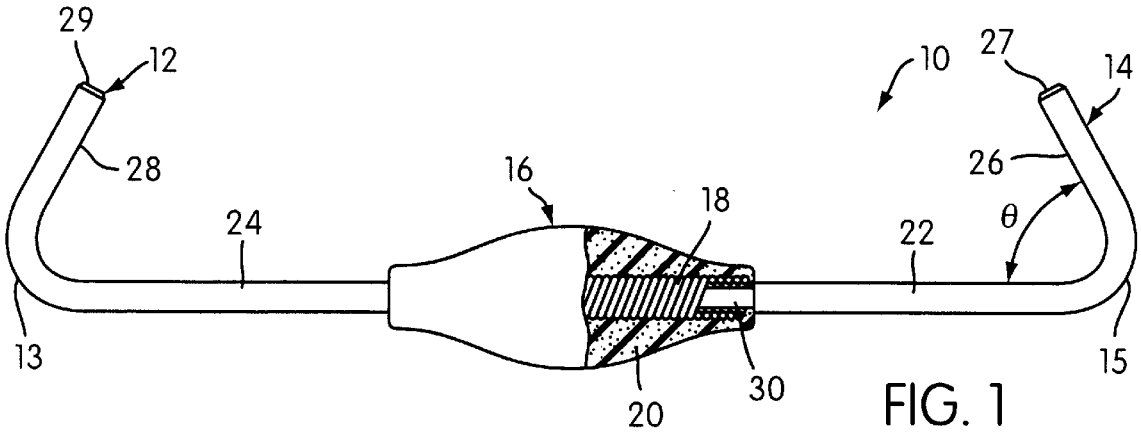
FIG. 1 is a front view, partially in cross-section, of a preferred embodiment of a flexural exercise device according to the present invention.
Figure 2:
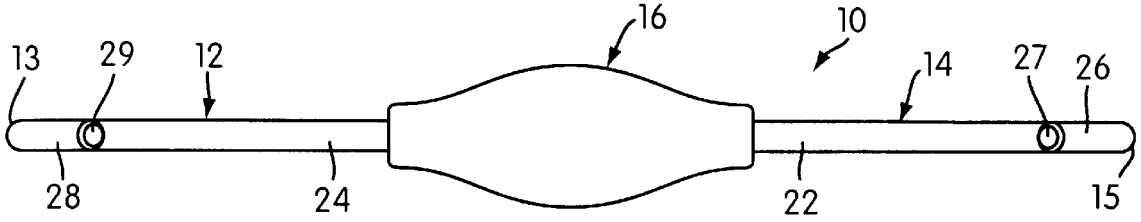
FIG. 2 is a top view of the flexural exercise device.

A flexural exercise device according to the present invention is designated generally by reference number 10 in FIGS. 1 and 2. The flexural exercise device 10 includes first and second handle arms 12 and 14 extending in opposite directions from a flexural middle portion 16, which functions to connect the first and second arms 12, 14 to one another. First and second handle arms 12, 14 are preferably of a steel tube construction covered with a foam padding layer. Alternatively, other strong and rigid materials, such as aluminum or fiberglass, may be used as well for the handle arms.

The flexural middle portion 16 preferably includes a steel coil spring 18 covered with a foam neck roll 20 made from a suitable foam padding material. First and second handle arms 12, 14, are preferably press fitted into the coil spring 18 and welded with a small weld at the ends of the coil spring 18 to secure the handle arms 12, 14 in place. Extended portion 30 of second handle arm 14 is shown press fitted into the end of spring 18 in FIG. 1.

Figure 3:
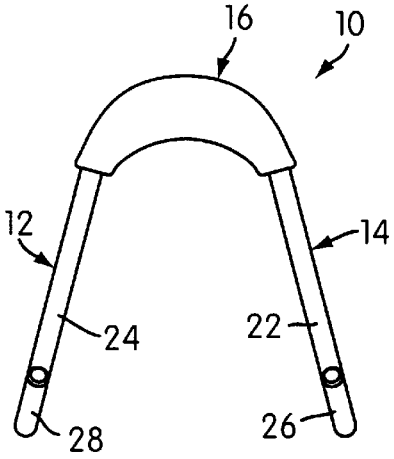
FIG. 3 is a top view of the flexural exercise device in a flexed position.
Figure 4:
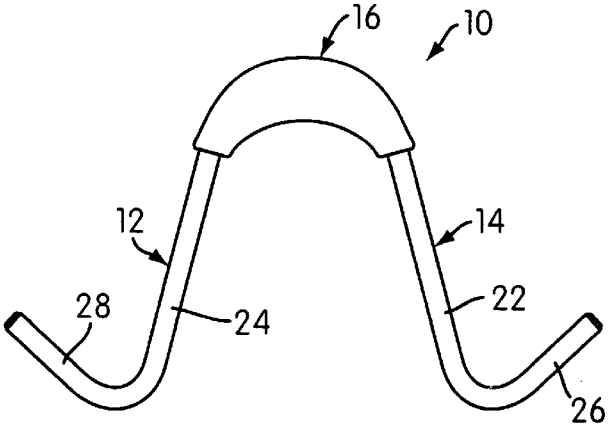
FIG. 4 is a front view of the flexural exercise device in a flexed position.

It can be appreciated by those skilled in the art that a variety of exercise can be affected by applying a bending moment to one or both of the handle arms 12 and 14 to cause the coil spring 18 to flex as shown in FIGS. 3 and 4. The stiffness of the coil spring 18 provides a flexural resistance against such flexing, thus providing a resistance exercise. The amount of resistance can be tailored by selection of the coil spring stiffness.

First handle arm 12 includes a straight initial portion 24 and a transversely bent handle portion 28. Similarly, second handle arm 14 includes a straight initial portion 22 and a transversely bent handle portion 26. Handle portions 26 and 28 are bent transversely with respect to the initial portions 22, 24, respectively, to positions whereby the angle e between the transversely bent handle portions and the respective straight initial portions is less than 90° as shown in FIG. 1. Accordingly, the handle portions 26 and 28 extend in directions generally toward one another, and the free ends 27, 29 of the respective handle portions 26, 28 are disposed inwardly of the outermost extremities 15, 13 of the respective handle arms 14, 12.

Although the straight initial portions and the transversely bent handle portions are preferably sections of a single continuous steel tube, handle portions 26 and 28 may be separate structural elements attached to the respective initial portions 22 and 24 by suitable connecting means, such as welding.

Because of the orientation of the handle portions 12 and 14 with respect to the straight initial portions 24 and 22, respectively, the flexural exercise device 10 of the present invention is ideally suited for performing butterfly exercises therewith.

Figure 5:
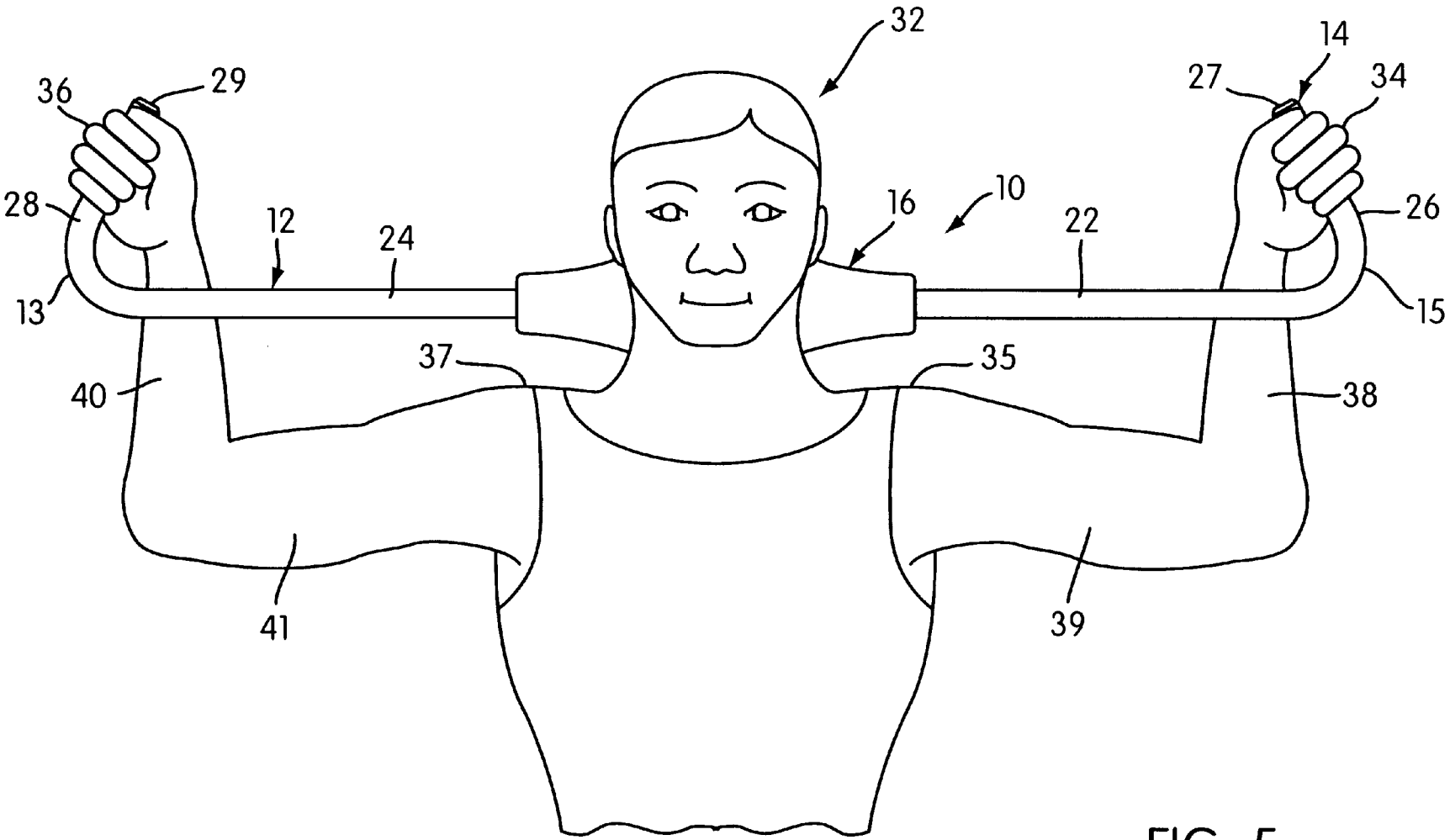
FIG. 5 is a front view of the flexural exercise device placed behind the neck of a user for performing a butterfly exercise.

As shown in FIG. 5, the flexural exercise device 10 can be placed behind the neck and shoulders of a user 32, and the user can extend his or her arms out sideways, bending them upwardly at the elbow and reaching behind the device 10 so as to grasp the handle portions 26 and 28 with the hands 34 and 36, respectively, at positions above the user's shoulders 35, 37 and disposed inwardly of the outermost extremities 15, 13 of the respective handle arms 14, 12. Because the handle portions 26 and 28 are bent inwardly with respect to the respective initial portions 22 and 24, that is, the angle between the handle portions and their respective initial portions is less than 90°, when the user reaches behind the device 10 and grasps the handle portions with his arms bent at the elbow, the insides of his forearms 38, 40 will bear against the handle arms 14 and 12, respectively, at positions below the respective transversely bent handle portions 26, 28.

With the device 10 held in this configuration, the user 32 can effect a butterfly exercise by bending both arms forwardly at the shoulders to bring the elbows toward one another while maintaining the upper arms 39, 41 in generally horizontal orientations. The flexural resistance provided by the spring 18 of the flexural middle portion 16 resists the butterfly movement to promote muscular development.

It will be realized that the foregoing preferred specific embodiment of the present invention has been shown and described for the purposes of illustrating the functional and structural principles of this invention and are subject to change without departure from such principles. Therefore, this invention includes all modifications encompassed within the spirit and scope of the following claims.

What is claimed is:

1. A flexural exercise device consisting of:

a first arm structure;

a second arm structure; and a flexural connecting assembly having structure for connecting said first arm structure with said second arm structure, said flexural connecting assembly comprising a coil spring having a longitudinal axis extending in an axial direction thereof with said first and second arm structures extending longitudinally with respect to said coil spring in generally opposite directions from said flexural connecting assembly when said first and second arm structures are in unflexed positions, said flexural connecting assembly being constructed and arranged to permit each of said first and second arm structures to flex with respect to said unflexed positions against a flexural resistance provided by said flexural connecting assembly by bending said first and second arm structures to deflect said coil spring laterally with respect to its longitudinal axis, said first arm structure including an initial portion extending away from said flexural connecting assembly in a longitudinal direction when said first arm structure is in said unflexed position and a transverse handle structure attached to said initial portion at a position spaced from said flexural connecting assembly, said second arm structure including an initial portion extending away from said flexural connecting assembly in a longitudinal direction opposite to the direction of the initial portion of said first arm structure when said first and second arm structures are in said unflexed positions and a transverse handle structure attached to said initial portion at a position spaced from said flexural connecting assembly, said transverse handle structures of the respective first and second arm structures including inwardly extending portions extending laterally away from the initial portions of the respective first and second arm structures in directions generally toward one another when said first and second arm structures are in said unflexed positions, so that a free end of each said transverse handle structure is disposed inwardly of an outermost extremity of the respective first and second arm structure, wherein said first and second arm structures are constructed and arranged with respect to said flexural connecting assembly to permit an upright user to position said device with said flexural connecting assembly behind the user's neck, said first and second arm structures directed sideways from the user, and the transverse handle structures of said first and second arm structures extending above the user's shoulders when said first and second arm structures are in said unflexed positions, and wherein said inwardly extending portions are adapted to permit the user to extend the user's arms outwardly and bent upwardly at the elbows and manually grasp the transverse handle structures of the respective first and second arm structures at positions above the user's shoulders and spaced inwardly from the outermost extremities of the respective first and second arm structures and effect a butterfly exercise by bending the user's arms at the shoulders toward one another in front of the user while keeping the arms bent upwardly at the elbows and while flexing said first and second arm structures from their unflexed positions against said flexural resistance by bending said first and second arm structures to deflect said coil spring laterally with respect to its longitudinal axis.

2. The flexural exercise device of claim 1, wherein said initial portion and said transverse handle structure of the respective first and second arm structures comprise continuous integral members.

3. The flexural exercise device of claim 1, wherein said continuous integral members comprise bent tubular steel stock.

4. The flexural exercise device of claim 1, where said first and second arm structures are covered with foam padding.

5. The flexural exercise device of claim 1, wherein said initial portions of the respective first and second arm structures are generally straight structural elements that are generally collinear with each other when said first and second arm structures are in said unflexed positions.

6. The flexural exercise device of claim 1, wherein each of said transverse handle structures comprises a single element having a generally straight portion extending to said free end and connected to said initial portion of the respective first or second arm structure at an angle with respect to said initial portion, said angle having a first and a second component, wherein the first component of the angle of each of said transverse handle structures is generally perpendicular to a portion of said initial portion of the respective first or second arm structure and the second components of the angles of said transverse handle structures are generally collinear with each other when said first and second handle structures are in said unflexed positions.

7. The flexural exercise device of claim 6, wherein the second components of the angles of said first and second transverse handle structures extend in directions generally toward one another.

8. The flexural exercise device of claim 1, wherein said flexural connecting assembly comprises a single elongated laterally resilient member with each of said first and second arm structures connected to opposite ends thereof.

9. The flexural exercise device of claim 8, wherein said single elongated laterally resilient member comprises a steel coil spring.

10. The flexural exercise device of claim 8 wherein said single elongated laterally resilient member is covered with a padded roll to protect a user's neck when said device is positioned with said flexural connecting assembly disposed behind a user's neck.

11. The flexural exercise device of claim 1, wherein said initial portions and said transverse handle structures of the respective first and second arm structures are constructed and arranged to permit the user's forearms to bear against portions of said initial portions as the user performs the butterfly exercise.

12. A flexural exercise device consisting of:

a first arm structure;

a second arm structure; and a flexural connecting assembly having structure for connecting said first arm structure with said second arm structure, said flexural connecting assembly comprising a coil spring having a longitudinal axis extending in an axial direction thereof with said first and second arm structures extending longitudinally with respect to said coil spring in generally opposite directions from said flexural connecting assembly when said first and second arm structures are in unflexed positions, said flexural connecting assembly being constructed and arranged to permit each of said first and second arm structures to flex with respect to said unflexed positions against a flexural resistance provided by said flexural connecting assembly by bending said first and second arm structures to deflect said coil spring laterally with respect to its longitudinal axis, said first arm structure including an initial portion extending away from said flexural connecting assembly in a longitudinal direction when said first arm structure is in said unflexed position and a transverse handle structure attached to said initial portion at a position spaced from said flexural connecting assembly, said second arm structure including an initial portion extending away from said flexural connecting assembly in a longitudinal direction opposite to the direction of the initial portion of said first arm structure when said first and second arm structures are in said unflexed positions and a transverse handle structure attached to said initial portion at a position spaced from said flexural connecting assembly, said transverse handle structures of the respective first and second arm structures including inwardly extending portions extending away from the initial portions of the respective first and second arm structures in directions generally toward one another when said first and second arm structures are in said unflexed positions, so that a free end of each said transverse handle structure is disposed inwardly of an outermost extremity of the respective first and second arm structure, wherein said first and second arm structures are constructed and arranged with respect to said flexural connecting assembly to permit an upright user to position said device with said flexural connecting assembly behind the user's neck, said first and second arm structures directed sideways from the user, and the transverse handle structures of said first and second arm structures extending above the user's shoulders when said first and second arm structures are in said unflexed positions, and wherein said inwardly extending portions are adapted to permit the user to extend the user's arms outwardly and bent upwardly at the elbows and manually grasp the transverse handle structures of the respective first and second arm structures at positions above the user's shoulders and spaced inwardly from the outermost extremities of the respective first and second arm structures and effect a butterfly exercise by bending the user's arms at the shoulders toward one another in front of the user while keeping the arms bent upwardly at the elbows and while flexing said first and second arm structures from their unflexed positions against said flexural resistance by bending said first and second arm structures to deflect said coil spring laterally with respect to its longitudinal axis.

* * * * *